United States Patent [19]

Yokoyama

[11] Patent Number: 5,031,221

[45] Date of Patent: Jul. 9, 1991

[54] DYNAMIC LOUDSPEAKER DRIVING APPARATUS

[75] Inventor: Kenji Yokoyama, Hamamatsu, Japan

[73] Assignee: Yamaha Corporation, Shizuoka, Japan

[21] Appl. No.: 199,479

[22] Filed: May 27, 1988

[30] Foreign Application Priority Data

Jun. 2, 1987 [JP] Japan ..... 62-138644
Jun. 11, 1987 [JP] Japan ..... 62-145738

[51] Int. Cl.[5] ..... H04R 3/00
[52] U.S. Cl. ..... 381/96; 381/59
[58] Field of Search ..... 381/96, 59

[56] References Cited

U.S. PATENT DOCUMENTS

| | | | |
|---|---|---|---|
| 2,887,532 | 5/1959 | Werner . | |
| 3,530,244 | 9/1970 | Reiffin | 381/96 |
| 3,647,969 | 3/1972 | Korn | 381/96 |
| 4,118,600 | 10/1978 | Stahl | 330/107 X |
| 4,243,839 | 1/1981 | Takahash et al. | 381/96 |
| 4,335,274 | 6/1982 | Ayers | 381/96 |
| 4,727,584 | 2/1988 | Hall | 381/96 |
| 4,741,040 | 4/1988 | Kaizer | 381/96 |
| 4,821,328 | 4/1989 | Drozdowski | 381/96 |

FOREIGN PATENT DOCUMENTS 181608 5/1986 European Pat. Off. .

OTHER PUBLICATIONS

A New Approach to Loudspeaker Damping, by Werner Clements, Aug. 1951, published in Audio Engineering.

Application of Negative Impedance Amplifiers to Loudspeaker Systems, by R. E. Werner and R. M. Carrel, Journal of the Audio Engineering Society, vol. 6, No. 4, Oct. 1958.

Effect of a Negative Impedance Source on Loudspeaker Performance, by Richard E. Werner, Journal of the Acoustical Society of America, vol. 29, No. 3, Mar. 1957.

The Journal of Audio Engineering Society, vol. 29, No. 9, Sep. 1981, *Synthesis of Loudspeaker Mechanical Parameters by Electrical Means: A New Method for Controlling Low-Frequency Loudspeaker Behavior,* Kark Erik Stahl.

*Primary Examiner*—Forester W. Isen
*Attorney, Agent, or Firm*—Scully, Scott, Murphy & Presser

[57] ABSTRACT

The dynamic loudspeaker driving apparatus consists of at least a power amplifier and a feedback circuit. The power amplifier amplifies an input signal so that the dynamic loudspeaker is driven by the amplified input signal. A detecting circuit is further provided in order to accurately detect a motional voltage produced at an equivalent motional impedance of dynamic loudspeaker, and the feedback circuit negatively feedbacks the detected motional voltage to the power amplifier so that distortions due to a transient response of a vibration system of dynamic loudspeaker will be eliminated. The amplified input signal is supplied to a first terminal of dynamic loudspeaker and a voltage at a second input terminal of dynamic loudspeaker is supplied to the feedback circuit, and impedance components other than the equivalent motional impedance can be canceled. In addition, it is possible to be further provided with a filter circuit having a frequency response characteristics which can be obtained by electrically simulating a voltage transmission characteristic against the equivalent motional impedance of dynamic loudspeaker. Thus, the input signal can be given with a desirable frequency characteristic by the filter circuit and then supplied to the power amplifier.

7 Claims, 9 Drawing Sheets

DYNAMIC LOUDSPEAKER DRIVING APPARATUS

BACKGROUND OF THE INVENTION

1. Field of the Invention

The present invention generally relates to a dynamic loudspeaker driving apparatus, and more particularly to a dynamic loudspeaker driving apparatus which can reduce levels of distortions in sound from a dynamic loudspeaker.

2. Prior Art

In general, a feedback circuit is arranged between input and output of a power amplifier provided within an amplifier unit of an audio device. By use of this feedback circuit, it is possible to reduce levels of noises and distortion components included in an output signal of the power amplifier.

In addition, the amplifier unit of the audio device may also be provided with a motional feedback circuit (hereinafter, referred to as MFB circuit) which feedbacks a signal corresponding to a vibration of a dynamic loudspeaker so as to reduce a distortion in an operation of the loudspeaker. Theoretically, motional voltage must be applied to a motional impedance of the dynamic loudspeaker, and the MFB circuit negatively feedbacks such motional voltage to the input of the power amplifier.

The above-mentioned motional impedance can be represented by ZM of an electrically equivalent circuit of the dynamic loudspeaker (hereinafter, referred simply to as a loudspeaker) shown in FIG. 1. In FIG. 1, Rv designates a dc resistance component of a voice coil, and Lv designates an inductance component of the voice coil. In FIG. 2, a solid line designates voltage Vi supplied to the dynamic loudspeaker, while a short dashes line designates motional voltage VM which is produced at the equivalent motional impedance ZM representative of a vibration system of the dynamic loudspeaker. The operating distortion of the vibration system of the loudspeaker represents a transient response component of the motional voltage VM.

When the MFB circuit is provided to the dynamic loudspeaker, the negative feedback quantity must become extremely large at the frequencies in the vicinity of a lowest resonance frequency of the dynamic loudspeaker. Hence, it is avoided to provide too much negative feedback quantity for the MFB circuit. In general, a frequency characteristic of the dynamic loudspeaker provided with the MFB circuit has a tendency that the frequency response characteristic must be easily lowered at low frequencies at which the negative feedback quantity must be concentrated. In order to prevent such frequency response characteristic from being lowered at low frequencies, a compensating low-ass filter circuit (i.e., compensating LPF circuit) is conventionally provided at an input side of the dynamic loudspeaker so that the frequency response characteristic will be raised at the low frequencies. However, it is impossible to obtain a perfect compensating characteristic from such LPF circuit.

FIG. 3 shows an example of a conventional dynamic loudspeaker driving apparatus providing the above-mentioned compensating LPF circuit. In FIG. 3, a feedback circuit 2 is connected between input and output sides of a power amplifier 1. In this case, a feedback ratio b of the feedback circuit 2 is set further smaller than one, while a gain of the power amplifier 1 is set further larger than one. Meanwhile, a dynamic speaker 3 and three resistors 4 to 6 constitute a bridge circuit 7. An output signal Es of this bridge circuit 7 diagrammatically corresponds to the motional voltage of the dynamic speaker 3, and such signal Es is detected by a transformer 8. A part of a detection signal outputted from the transformer 8 is feedbacked to the input side of power amplifier 1. In the circuit shown in FIG. 3, the resistors 4 to 6 and the transformer 8 represent the MFB circuit.

In addition, a compensating LPF circuit 9 is provided at input side of the power amplifier 1, and lowering of low frequency characteristics of the circuit shown in FIG. 3 is improved and compensated by the MFB circuit. More specifically, the compensating LPF circuit 9 adequately raises a signal level of input signal Vi in the low frequency range, and the lowering of the low frequency characteristics is improved.

The MFB circuit used in the conventional audio amplifier unit is exclusively used for reducing distortions and noises included in a signal outputted from the power amplifier. However, such MFB circuit is not used for perfectly eliminating distortions due to the transient response of the vibration system of the dynamic loudspeaker at all. In short, the main portion of the conventional dynamic loudspeaker driving apparatus is the negative feedback portion, and the MFB circuit is merely used as an auxiliary circuit of the dynamic loudspeaker driving apparatus.

As shown in FIG. 3, the MFB circuit is a detection circuit constituted by the transformer and the bridge circuit consisting of resistors only. Hence, detection voltage detected by this detection circuit is not identical to the motional voltage in a strict sense. In other words, the detection voltage and the motional voltage are different in waveform, peak value and phase. For this reason, it is naturally impossible to provide much negative feedback, and the over-all frequency characteristics must be irregularly varied. Hence, the characteristics which must be given to the compensating LPF circuit must be extremely complicated, so that it is impossible to compensate the frequency characteristic of the dynamic loudspeaker with accuracy. Therefore, the conventional dynamic loudspeaker driving apparatus can only provide the circuit which can adequately raise the output level in the low frequency range.

As described heretofore, in the conventional audio amplifier unit, it is impossible to perfectly eliminate the all distortions due to the transient response of the vibration system of the dynamic loudspeaker.

Meanwhile, the conventional MFB circuit can use a pressure sensor, a temperature sensor, a microphone or other sensors in order to detect the motional voltage. Instead of using the above-mentioned sensors, a bridge circuit can be used for detecting the motional voltage produced at a voice coil of the loudspeaker, as described before. These techniques are disclosed in a monthly magazine "Radio Technique" published in Japan; October Issue and November Issue in 1984, and February Issue in 1985, for example.

However, in the above-mentioned MFB circuit using the sensors, a phase revolution of a detection output of such sensor must be increased, for example. Hence, there must be a limit of a feedback quantity due to an ability of the sensor. If the feedback quantity is set large, the MFB circuit will oscillate by itself. As a result, the conventional MFB circuit is disadvantageous in that a distortion reducing effect of the loudspeaker must become small.

On the other hand, the MFB circuit using the bridge circuit is disadvantageous in that the circuit constitution thereof must be complicated.

As described heretofore, the conventional dynamic loudspeaker driving apparatus adopting the MFB circuit must detect the motional voltage. For this reason, it is impossible to sufficiently reduce the levels of the distortions of the loudspeaker.

SUMMARY OF THE INVENTION

It is accordingly a primary object of the present invention to provide a dynamic loudspeaker driving apparatus which can detect the motional voltage with accuracy and then negatively feedback the detected motional voltage by 100% so that the distortions due to the transient response of the vibration system of the dynamic loudspeaker will be perfectly eliminated.

It is another object of the present invention to provide a dynamic loudspeaker driving apparatus which is constituted not to detect the motional voltage but to cancel impedance components other than an equivalent motional impedance of the vibration system of the dynamic loudspeaker so that it is possible to perfectly eliminate the distortions due to the transient response of the vibration system of the dynamic loudspeaker.

In a first aspect of the invention, there is provided a dynamic loudspeaker driving apparatus comprising:

(a) an amplifier having a large open-loop-gain for driving a dynamic speaker;

(b) detecting means for detecting a motional voltage applied to an equivalent motional impedance of the dynamic speaker;

(c) feedback means for negatively feedbacking the motional voltage to an input terminal of said amplifier by a transmission gain "1"; and (d) input means for supplying an input signal to the input terminal of the amplifier via a filter circuit which electrically simulates a voltage transmission characteristics against the equivalent motional impedance of dynamic speaker.

In a second aspect of the invention, there is provided a dynamic loudspeaker driving apparatus for amplifying an input signal and driving a dynamic loudspeaker by the amplified input signal so that impedance components other than an equivalent motional impedance of the dynamic loudspeaker can be canceled.

In a third aspect of the invention, there is provided a dynamic loudspeaker driving apparatus comprising:

(a) a filter circuit having a frequency response characteristic which is obtained by electrically simulating a voltage transmission characteristic against an equivalent motional impedance of a dynamic loudspeaker, the filter circuit giving a desirable frequency compensating characteristic to an input signal; and (b) driving means having a negative output impedance which can cancel impedance components other than the equivalent motional impedance, the driving means driving the dynamic loudspeaker by an output signal of the filter circuit.

In a fourth aspect of the invention, there is provided a dynamic loudspeaker driving apparatus comprising:

(a) a power amplifier for amplifying an input signal so that the amplified input signal is supplied to a first input terminal of a dynamic loudspeaker having an equivalent motional impedance; and (b) a servo amplifier for negatively feedbacking a voltage at a second input terminal of the dynamic loudspeaker to the power amplifier, whereby impedance components other than the equivalent motional impedance can be canceled.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
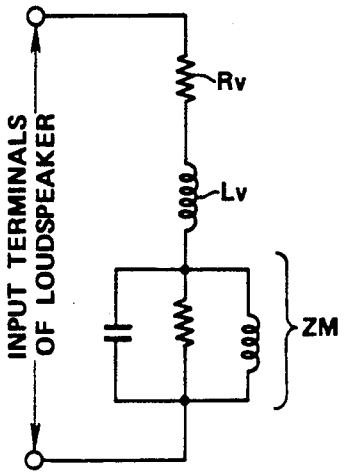
FIG. 1 is a circuit diagram showing an electrically equivalent circuit of the speaker.
Figure 2:
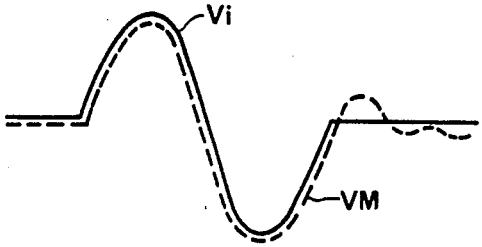
FIG. 2 shows waveforms of the input voltage supplied to the loudspeaker and the motional voltage applied to the equivalent motional impedance of the vibration system of the loudspeaker.
Figure 3:
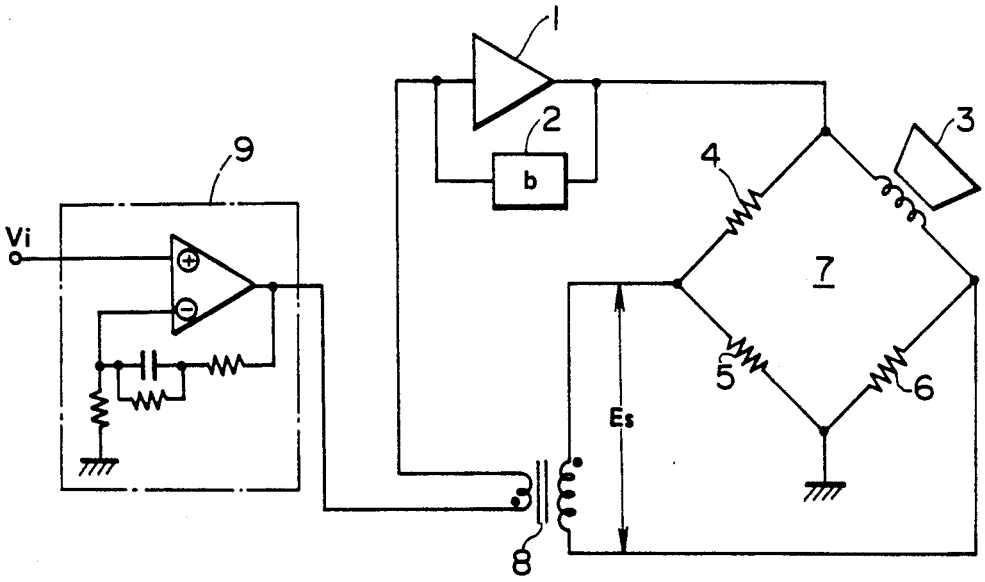
FIG.3 (PRIOR ART)
FIG. 3 is a circuit diagram showing an electric constitution of the conventional dynamic loudspeaker driving apparatus.

Next, description will be given with respect to preferred embodiments of the present invention in conjunction with FIGS. 4 to 17, wherein like reference characters designate like or corresponding parts throughout the several drawings.

[A]FIRST EMBODIMENT

Figure 4:
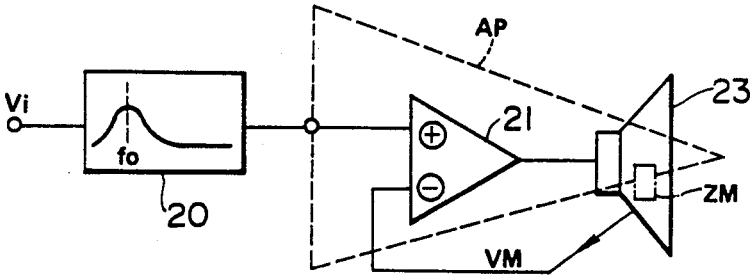
FIG. 4 is a block diagram showing a basic constitution of a first embodiment of the present invention.

First, description will be given with respect to a basic constitution of a first embodiment of the present invention. FIG. 4 is a block diagram showing the basic constitution of the first embodiment of the present invention. In FIG. 4, the motional voltage VM is applied to the equivalent motional impedance ZM of the vibration system of the dynamic speaker (or dynamic loudspeaker) 23, and such motional voltage VM is directly supplied to an inverting input terminal of power amplifier 21, whereby the motional voltage VM will be negatively feedbacked by 100%. Hence, a system AP consisting of the power amplifier 21 and the dynamic speaker 23 can be considered as an equivalent voltage amplifier having a voltage gain "1" against the motional impedance ZM.

In addition, 20 designates a band-pass filter (BPF) circuit which constitutes input means of the first embodiment. The reasons why such BPF circuit 20 is provided will be described as follows.

Figure 5A:
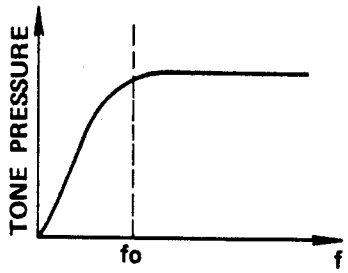
FIGS. 5A and 5B and FIGS. 6A to 6C show frequency response characteristics for explaining an operation of the first embodiment.
Figure 6A:
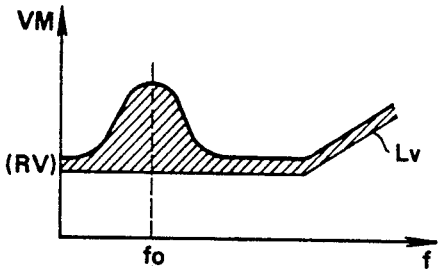
Figure 6B:
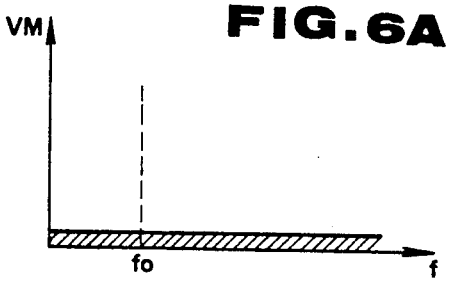
Figure 6C:
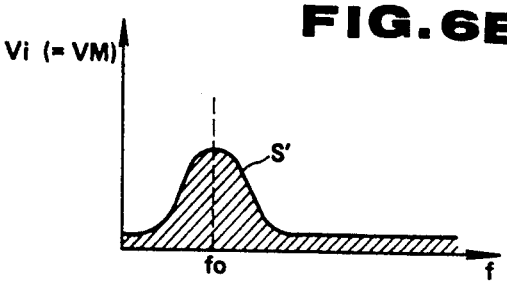

In general, when the constant voltage is applied to the input terminal of the dynamic loudspeaker to thereby drive the dynamic loudspeaker with the constant voltage, it is possible to obtain a flat curve of tone pressure vs frequency characteristic as shown in FIG. 5A. In this case, a relation between the motional voltage VM and the frequency within the dynamic loudspeaker can be shown in FIG. 6A. In FIGS. 6A to 6C, each of hatching parts represents actual acoustic energy.

Figure 5B:
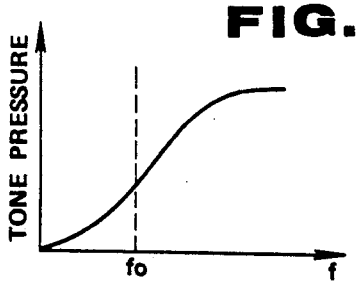

On the other hand, when the motional voltage VM is negatively feedbacked by 100%, a curve of tone pressure vs frequency characteristic does not become flat and the tone pressure in the low frequency range must be lowered as shown in FIG. 5B. In this case, the relation between the motional voltage VM and the frequency will be as shown in FIG. 6B, wherein the motional voltage VM directly corresponds to the input signal Vi perfectly and thus the variation of motional voltage VM itself is perfectly suppressed. As a result, the distortions in an operation of the loudspeaker are prevented from being caused. However, in the case where the motional voltage VM is negatively feedbacked by 100% as shown in FIG. 6B, the curve of tone pressure vs frequency characteristic does not become flat as shown in FIG. 5B. For this reason, the waveform of input signal Vi is modified as shown in FIG. 6C by the BPF circuit 20 so that the waveform of motional voltage VM will become equivalent to the waveform in case shown in FIG. 5A. In other words, the BPF circuit 20 provided to the input side of the power amplifier 21 is the circuit which can electrically simulate the voltage transmission characteristics against the motional impedance of the vibration system of the dynamic speaker 23. Due to this BPF circuit 20, the dynamic loudspeaker driving apparatus provided with the MFB circuit can present the flat curve of tone pressure vs frequency characteristic as shown in FIG. 5A.

As described heretofore, the first embodiment has a circuit constitution provided with the system in which the motional voltage VM is negatively feedbacked by 100% between the power amplifier 21 and the dynamic speaker 23. Due to this system, the first embodiment can perfectly eliminate the distortions caused by the transient response of the vibration system of the dynamic speaker 23. In addition, the first embodiment simulates the voltage transmission characteristics of the conventional dynamic loudspeaker at the input side of power amplifier 21.

Figure 7:
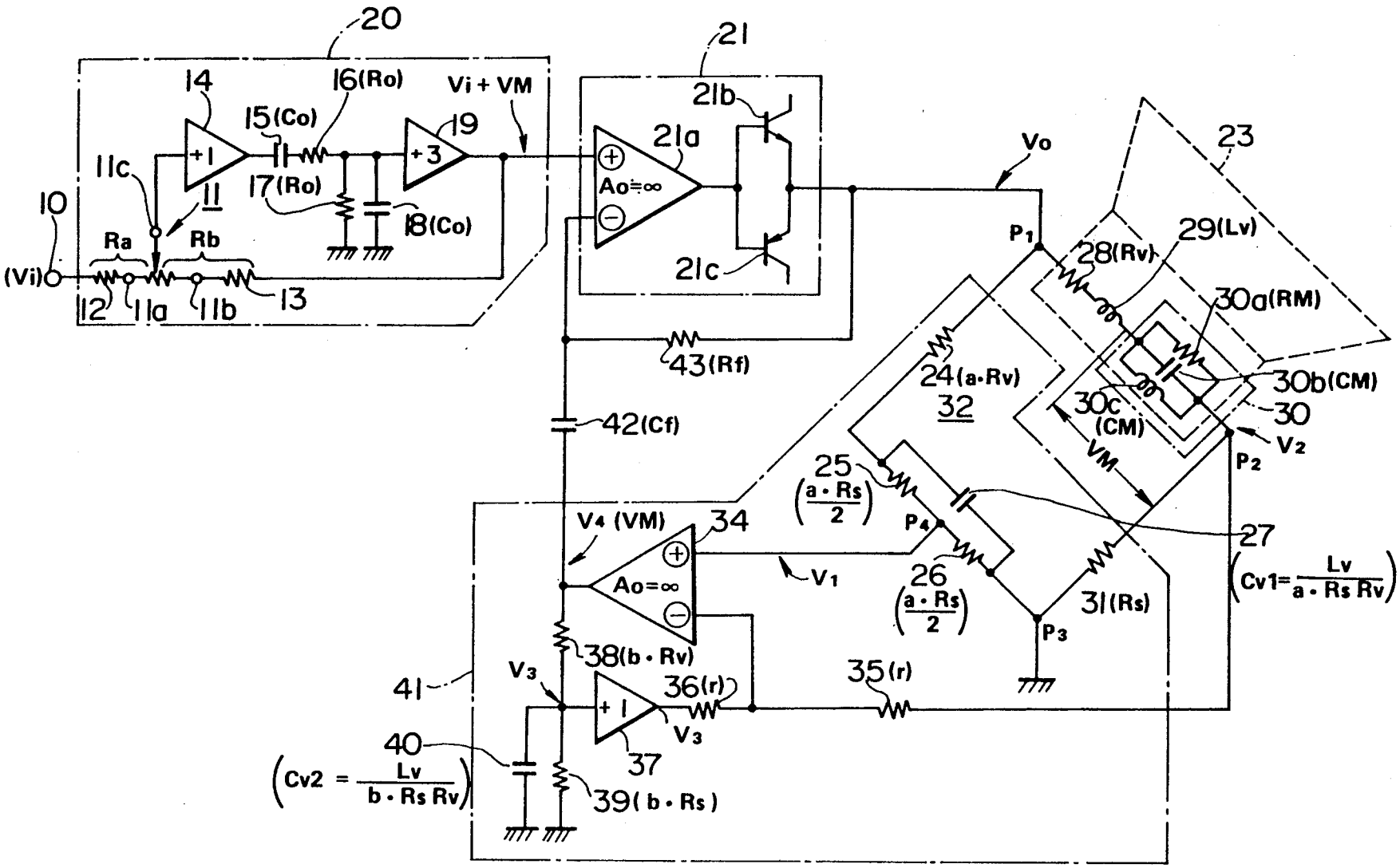
FIG. 7 is a circuit diagram showing an electric first embodiment.

Next, description will be given with respect to the first embodiment in detail in conjunction with FIGS. 7, 8A and 8B. FIG. 7 is a circuit diagram showing an electric constitution of the first embodiment.

In FIG. 7, a first fixed terminal 11*a* of variable resistor 11 is connected to a signal input terminal 10 via a resistor 12, while a second fixed terminal 11*b* thereof is connected to a first terminal of resistor 13. In addition, a slider terminal 11*c* of variable resistor 11 is connected to an input terminal of amplifier 14. In this case, resistance Ra denotes resistance combined by resistance of resistor 12 and resistance between the terminals 11*a* and 11*c* of variable resistor 11, while resistance Rb denotes resistance combined by resistance of resistor 13 and resistance between the terminals 11*b* and 11*c* of variable resistor 11. The amplifier 14 is designed to have a voltage gain "+1". An output terminal of amplifier 14 is connected to a first terminal of capacitor 15 (having capacitance C0), while a second terminal of capacitor 15 is connected to a first terminal of resistor 16 (having resistance R0). A second terminal of resistor 16 is grounded via a parallel circuit consisting of a resistor 17 (having resistance R0) and a capacitor 18 (having capacitance C0) and then connected to an input terminal of amplifier 19. This amplifier 19 is designed to have a voltage gain "+3". In addition, an output terminal of amplifier 19 is connected to a second terminal of resistor 13 and then connected to anon-inverting input terminal of amplifier 21*a*. The BPF circuit 20 is constituted by the amplifiers 14 and 19, the variable resistor 11, the resistors 12, 13, 16 and 17, the capacitors 15 and 18 as described above.

Next, description will be given with respect to characteristics of BPF circuit 20. This BPF circuit has a resonance frequency f1 which is determined by the resistances of resistors 16 and 17, the capacitances of capacitors 15 and 18. In short, the resonance frequency f1 is represented by the following formula (1).

$$f1 = \frac{1}{2}\pi C0 \cdot R0 \quad (1)$$

In addition, a sharpness Q of resonance is represented by the following formula (2).

$$Q = (1 + Ra/Rb)/3 \quad (2)$$

By suitably selecting the capacitances of capacitors 15 and 18, the resistances of resistors 16 and 17 in the BPF circuit 20, the resonance frequency f1 of the BPF circuit 20 can be coincided with the lowest resonance frequency f0 of the dynamic speaker 23. By adjusting the variable resistor 11, a frequency bandwidth in resonance characteristics can be arbitrarily varied. In other words, in the case where the resistance Ra is set larger than the resistance Rb by adjusting the variable resistor 11, the value Q becomes large so that a frequency bandwidth of resonance characteristics will become narrow. On the contrary, in the case where the resistance Ra is set smaller than the resistance Rb, the value Q becomes small so that the frequency bandwidth of resonance characteristics will become wide. Accordingly, by using the BPF circuit 20, the resonance characteristics of input signal Vi can be simulated to the voltage transmission characteristics against the motional impedance of dynamic speaker 23 with accuracy.

In FIG. 7, the power amplifier 21 is constituted by the voltage amplifier 21*a* having a large open-loop-gain and a power stage consisting of a NPN type transistor 21*b* and a PNP type transistor 21*c*. An output terminal of amplifier 21*a* is connected to both base terminals of transistors 21*b* and 21*c*. Both emitter terminals of transistors 21*b* and 21*c* are connected in common to constitute an output terminal of power amplifier 21.

The output terminal of power amplifier 21 is connected to a first terminal of dynamic speaker 23, and this output terminal is grounded via a resistor 24 (having resistance of a.Rv; "a" denotes an arbitrary coefficient), a resistor 25 (having resistance of a.Rs/2) and a resistor 26 (having resistance of a.Rs/2) in series. In this case, a capacitor 27 (having capacitance Cv1=Lv/(a.Rs.Rv)) is connected in parallel to a serial circuit consisting of the resistors 25 and 26. In addition, a second terminal of dynamic speaker 23 is grounded via a resistor 31 (having resistance Rs). The dynamic speaker 23 can be electrically represented by an equivalent circuit which is constituted by a serial circuit consisting of a voice coil resistor 28 (having resistance Rv), a voice coil inductance 29 (having inductance Lv) and an equivalent circuit 30 of a mechanical vibration system of dynamic speaker 23. This equivalent circuit 30, i.e., the motional impedance, can be represented by a parallel circuit consisting of a resistor **30*a*, a capacitor 30*b* and a coil (inductance) 30*c***.

The above-mentioned dynamic speaker 23, the resistors 24, 25, 26 and 31, the capacitor 27 constitute a bridge circuit 32.

Next, description will be given with respect to functions of the bridge circuit 32. The combined resistance of the resistors 24 to 26 within the bridge circuit 32 can be represented by (a.Rv+a.Rs/2+a.Rs/2). Such combined resistance is set sufficiently larger than another combined resistance (Rv+Rs) of the resistors 28 and 31, and the resistance Rs of resistor 31 is set sufficiently smaller than the resistance Rv of resistor 28. Meanwhile, a condition as described by the following formula (3) is set between the dynamic speaker 23 and the resistors 24, 25, 26 and 31.

$$(a \cdot Rv)/(a \cdot Rs) = Rv/Rs \tag{3}$$

By adequately setting the resistances of resistors as described above, it becomes possible to accurately detect the motional voltage VM between a connection point P4 formed between the resistors 25 and 26 and another connection point P2 formed between the resistor 31 and the second terminal of dynamic speaker 23, which will be described later.

Next, the above-mentioned connection point P4 between the resistors 25 and 26 is connected to a non-inverting input terminal of amplifier 34. In addition, the connection point P2 between the dynamic speaker 23 and the resistor 31 is connected to an inverting input terminal of amplifier 34 via a resistor 35 (having resistance r), and this connection point P2 is also connected to a first terminal of resistor 36 (having resistance r). A second terminal of resistor 36 is connected to an output terminal of amplifier 37. This amplifier 37 is designed to have a voltage gain "+1". An input terminal of amplifier 37 is connected to an output terminal of amplifier 34 via a resistor 38 (having resistance b.Rv; "b" denotes an arbitrary coefficient), and this input terminal of amplifier 37 is grounded via a parallel circuit consisting of a resistor 39 (having resistance b.Rs) and a capacitor 40 (having capacitance Cv2=Lv/(b.Rs.Rv)). The bridge circuit 32, the amplifiers 34 and 37, the resistors 35, 36, 38 and 39, and the capacitor 40 constitute a bridge amplifier 41. This bridge amplifier 41 corresponds to detecting means.

The output terminal of amplifier 34 is connected to a first terminal of capacitor 42 (having capacitance Cf). A second terminal of capacitor 42 is connected to a first terminal of resistor 43 (having resistance Rf) and also connected to the inverting input terminal of amplifier **21*a* within the power amplifier 21. A second terminal of resistor 43 is connected to the output terminal of power amplifier 21. The capacitor 42 is used for blocking a direct current, and the resistor 43** is used as a feedback resistor.

Next, description will be given with respect to a detecting principle of the motional voltage VM by use of the bridge amplifier 41.

Figure 8A:
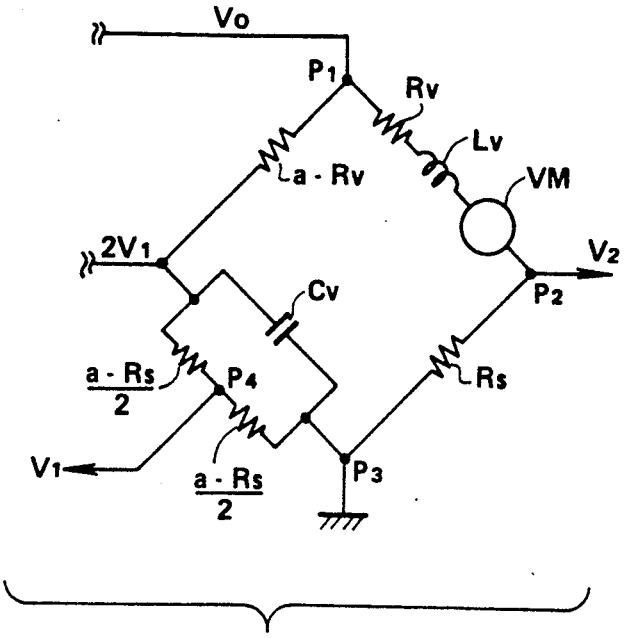
FIGS. 8A and 8B are circuit diagrams for explaining functions of a bridge detection circuit shown in FIG. 7.

First, in the bridge circuit 32 shown in FIG. 8A, the relation between these voltages V0 to V4 can be represented by the following formula (4). In this formula, V0 denotes a voltage supplied from the power amplifier 21, V1 denotes a voltage supplied to the non-inverting input terminal of amplifier 34, V2 denotes a voltage at the connection point P2, V3 denotes a voltage at the output terminal of amplifier 37 and V4 denotes a voltage at the output terminal of amplifier 34.

$$\begin{aligned} V3 &= V4 \cdot (b \cdot Rs//Cv2)/(b \cdot Rs//Cv2 + b \cdot Rv) \\ &= V4 \cdot Rs/(Rs + Rv + jwLv) \end{aligned} \tag{4}$$

wherein

Cv2=Lv/(b.Rs.Rv) and "Rs//Cv2" means a combined impedance of parallel circuit consisting of resistance Rs and capacitance Cv.

In addition, the following formula (5) can be obtained based on a characteristic of operational amplifier with feedback.

$$\begin{aligned} V1 &= (r \cdot V2 + r \cdot V3)/(r + r) = (V2 + V3)/2 \therefore V3 = 2 \cdot V1 - \\ &\quad - V2 \end{aligned} \tag{5}$$

Figure 8B:
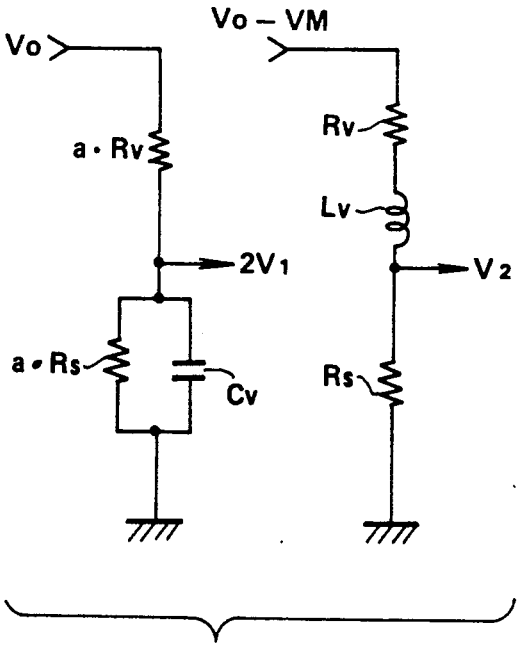

Next, the voltages V1 and V2 can be obtained by referring to FIG. 8B as described by the following formulae (6) and (7).

$$\begin{aligned} 2 \cdot V1 &= V0\ (a \cdot Rs//Cv1)/(a \cdot Rs//Cv1 + a \cdot Rv) \\ &= V0 \cdot Rs//(Rs + Rv + jwLv) \end{aligned} \tag{6}$$

wherein

Cv1=Lv/(*a*·Rs·Rv).

$$V2 = (V0 - VM) \cdot Rs/(Rs + Rv + jwLv) \tag{7}$$

When the above-mentioned formulae (6) and (7) are put in the formula (5), the following formula (8) can be obtained.

$$V3 = VM \cdot Rs/(Rs + Rv + jwLv) \tag{8}$$

Thus, the following formula (9) can be obtained from the formulae (4) and (8).

$$V4 = VM \tag{9}$$

Accordingly, the motional voltage VM of the dynamic speaker 23 can be obtained from the output of amplifier 34 with accuracy.

Next, description will be given with respect to the operation of the first embodiment in conjunction with FIG. 7.

First, the input signal Vi applied to the signal input terminal 10 is supplied to the BPF circuit 20 wherein the signal level of input signal Vi is raised in the resonance frequency f1. More specifically, a signal (Vi+VM) outputted from the BPF circuit 20 has a frequency bandwidth characteristics which are obtained by simulating the voltage transmission characteristics of the dynamic speaker 23. This signal (Vi+VM) is supplied to the non-inverting input terminal of amplifier 21*a* within the power amplifier 21 wherein the signal (Vi+VM) is amplified. Then, the amplified signal is supplied to the dynamic speaker 23, whereby the dynamic speaker 23 will be driven. At this time, the motional voltage VM is produced between the both terminals of equivalent circuit 30 of the dynamic speaker 23. Such motional voltage VM is detected by the bridge amplifier 41, and the detected motional voltage VM is supplied to the inverting input terminal of amplifier 21*a* via the capacitor 42. In short, the motional voltage VM is feedbacked by 100%.

Since the motional voltage VM is feedbacked by 100% as described above, it is possible to perfectly eliminate the distortions due to the transient response of the vibration system of dynamic speaker 23. In addition, the first embodiment simulates the voltage transmission characteristics of dynamic speaker 23 at the input stage thereof. Hence, similar to the conventional apparatus, the first embodiment can realize the flat curve of tone pressure vs frequency characteristic. Moreover, the frequency range of the frequency characteristic of the first embodiment can be stretched to further lower frequency range by varying the voltage transmission characteristics at the input stage, regardless of the lowest resonance frequency of the frequency characteristic.

[B]SECOND EMBODIMENT

Figure 9:
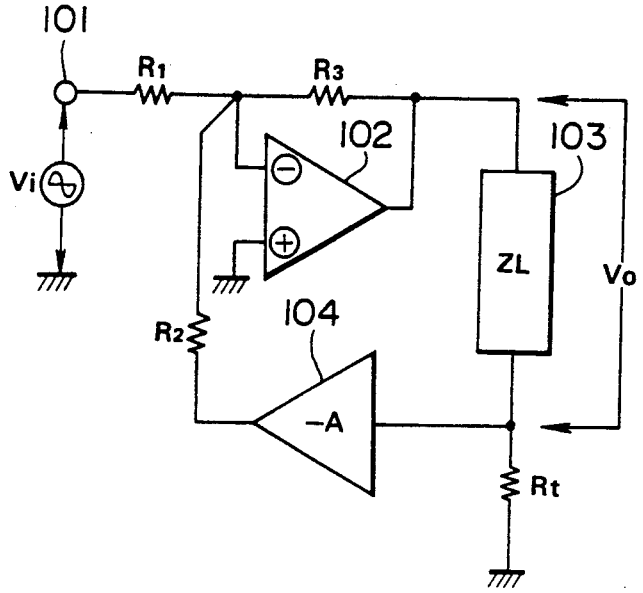
FIG. 9 is a circuit diagram showing an essential constitution of the dynamic loudspeaker driving apparatus according to a second embodiment of the present invention.

FIG. 9 is a circuit diagram showing an essential constitution of the dynamic loudspeaker driving apparatus according to a second embodiment of the present invention.

In FIG. 9, an input terminal 101 applied with an input voltage Vi is connected to an inverting input terminal of an operational amplifier (or a power amplifier) 102 via a resister R1. A non-inverting input terminal of the operational amplifier 102 is grounded, while the output terminal thereof is connected to a connection point between the resistor R1 and the non-inverting input terminal thereof via a resistor R3. In addition, the output terminal of the operational amplifier 102 is grounded via a load 103 (which is a speaker, for example) having an impedance ZL and a resistor Rt in series. A connection point between the load 103 and the resistor Rt is connected to a connection point among the inverting input terminal of the operational amplifier 102, the resistors R1 and R3 via an amplifier (or a servo amplifier) 104 having gain "−A" and the resistor R2 in series.

In the above-mentioned constitution, when voltage Vo is applied between both terminals of the load 103, a transmission characteristic represented by "−Vo/Vi" can be obtained from the following formula (10).

$$-Vo/Vi=(R3/R1)\cdot[1/]\{1+(Rt/ZL)\cdot(-1-A\cdot R3/R2)\}] \quad (10)$$

Hence, an output impedance (or a drive impedance) Zo can be obtained from the following formula (11).

$$Zo=Rt(1-A\cdot R3/R2) \quad (11)$$

According to the above formula (11), it is possible to set the value of the output impedance Zo to a negative value under a condition where a value of A·R3/R2 is larger than one.

Figure 10:
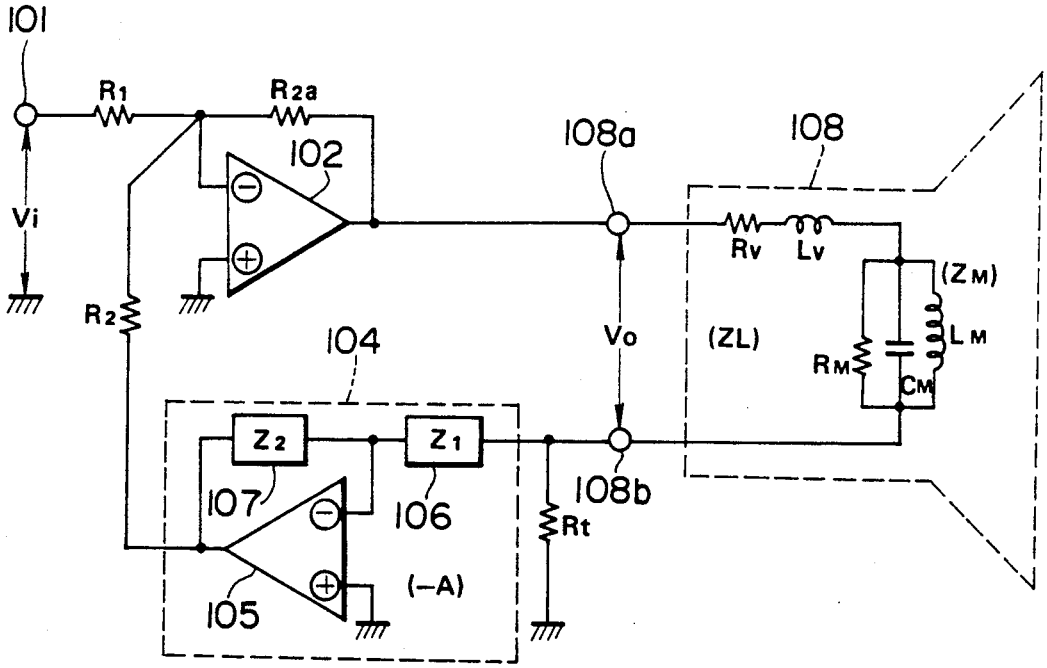
FIG. 10 is a circuit diagram showing the second embodiment of the present invention.

Next, description will be given with respect to a second embodiment of the present invention in conjunction with FIG. 10. This second embodiment represents a case where the essential circuit shown in FIG. 9 is applied to an actual speaker driving circuit. In FIG. 10, parts identical to those shown in FIG. 9 will be designated by the same numerals.

As shown in FIG. 10, a resistor R2a (having a resistance equal to that of the resistor R2) is used instead of the resistor R3. As the amplifier 104, a servo amplifier consisting of an operational amplifier 105, impedance loads 106 and 107 is used. Further, a dynamic speaker 108 is used instead of the load 103.

In FIG. 10, a connection point between the output terminal of the operational amplifier 102 and the resistor R2a is connected to a terminal 108*a* of the dynamic speaker 108, while another terminal 108*b* of the dynamic speaker 108 is grounded via the resistor Rt. In addition, the terminal 108*b* is connected to an inverting input terminal of the operational amplifier 105 via the impedance load 106 (having an impedance Z1), and a non-inverting input terminal of the operational amplifier 105 is grounded. The output terminal of the operational amplifier 105 is connected to a connection point between the inverting input terminal thereof and the impedance load 106 via the impedance load 107 (having an impedance Z2) and also connected to the resistor R2.

Meanwhile, in the speaker 108, Rv and Lv respectively designate a dc resistance and an inductance of a voice coil, and a resistor RM, a capacitor CM and a coil LM within a parallel circuit designate respective components of a motional impedance ZM of a drive system of the speaker 108.

When relations of R2=R3 and A=Z2/Z1 are respectively put into the formulae (10) and (11), the transmission characteristic (−Vo/Vi) and the output impedance of the second embodiment can be obtained from the following formulae (12) and (13).

$$-Vo/Vi=(R2/R1)\cdot[1/]\{1+(Rt/ZL)\cdot(1-Z2/Z1)\}] \quad (12)$$

$$Zo=Rt(1-Z2/Z1) \quad (13)$$

Next, description will be given with respect to a detailed constitution of the servo amplifier 104 in conjunction with FIG. 11.

In order to drive the motional impedance ZM under a constant voltage, the value of the drive impedance Zo is to be set equal to a value of −(Rv+jwLv). When such relation is put into the formula (13), the following relation can be obtained.

$$-(Rv+jwLv)=Rt\cdot(1-Z2/Z1)$$
$$\therefore Z2/Z1=(Rt+Rv)/Rt+jwLv/Rt \quad (14)$$

Hence, a capacitance of the capacitor C1 and resistances of resistors R4 and R5 can be set as follows.

R4 =k1·Rt
R5 =k1·(Rt+Rv)
C1 =C/k1 where C =Lv/[Rt·(Rt+Rv)] and k1 is set further larger than one.

Figure 11:
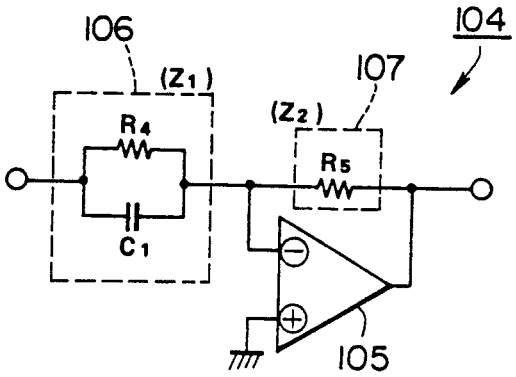
FIG. 11 is a circuit diagram showing an embodiment of an essential portion of the second embodiment.
Figure 12:
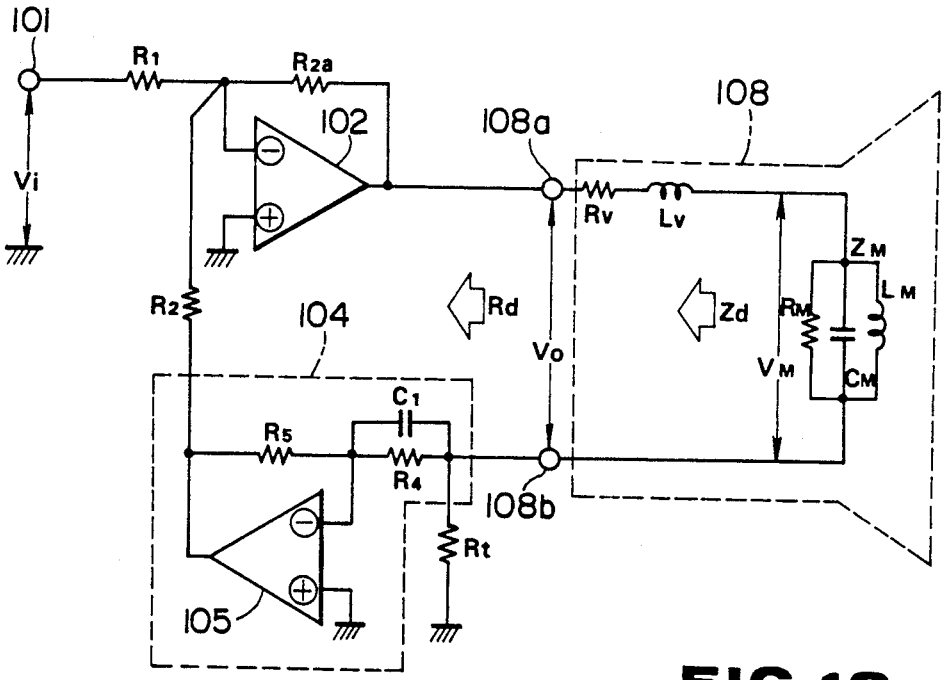
FIG. 12 is a circuit diagram showing a concrete constitution of the second embodiment.

When the circuits shown in FIGS. 10 and 11 are combined together, a circuit shown in FIG. 12 can be obtained. In this case, when the condition represented by the formula (14) and a relation of ZL=Rv+jwLv+ZM are put into the formula (12), the following transmission characteristic (−Vo/Vi) of formula (15) can be obtained.

$$-Vo/Vi=R2/R1\cdot[(Rv+jwLv+ZM)/Z] \quad (15)$$

In addition, when a relation of $VM/Vo=ZM/(Rv+jwLv+ZM)$ is put into this formula (15), the transmission characteristic including the motional impedance ZM can be obtained from the following formula (16).

$$-VM/Vi=R2/R1 \quad (16)$$

Further, an output impedance Rd and a drive impedance Zd of the motional impedance ZM can be obtained as follows.

$$Rd=-(Rv+jwLv) \quad (17)$$

$$Zd=0 \quad (18)$$

Incidentally, as the setting method of circuit constants for setting the drive impedance Zd equal to $-(Rv+jwLv)$ in order to drive the motional impedance ZM under the constant voltage, modified methods other than the method described before can be adopted. For example, impedance loads Z3 and Z4 (not shown) can be used instead of the resistors R2 and R3 in the circuit shown in FIG. 9, and constants of these impedance loads Z3 and Z4 can be set so that the value of the formula (11) will be set equivalent to the drive impedance Zd.

As known well, each of the value Q and a lowest resonance frequency f0 has a value due to a resonance characteristic curve of the motional impedance ZM. However, when the speaker 108 is actually driven, there is a problem in that the above resonance characteristic curve (i.e., a variation of the motional impedance ZM) must be effective due to the resistance Rv of the voice coil and the output impedance Rd of the amplifier on the voltage transmission characteristics.

In order to solve such problem, the resonance impedance only must be subjected to a voltage drive by an amplifier having no output impedance and infinite power, for example. In this case, the voltage between both terminals of the resonance impedance is not effected by the value Q and the silent resonance frequency f0 but identical to the input voltage. In short, it is not necessary to consider the value Q and the resonance frequency f0 in this case. In addition, all movements of a vibration plate of the actual loudspeaker is translated into an electromotive force between both terminals of the motional impedance ZM. Hence, by driving the motional impedance ZM under the constant voltage, all free movements of the vibration plate of the loudspeaker can be controlled. For this reason, the transient response of the vibration system can not be caused at all, hence, it is possible to eliminate the distortions due to such transient response.

As shown by FIG. 12 and formulae (16) to (18), the present invention can drive the motional impedance ZM by zero-ohm (or under the constant voltage). However, the motional impedance ZM becomes extremely low at the resonance frequency (f0). Hence, current supplying ability at driving side is required to be large at the frequencies other than the resonance frequency f0.

Figure 13:
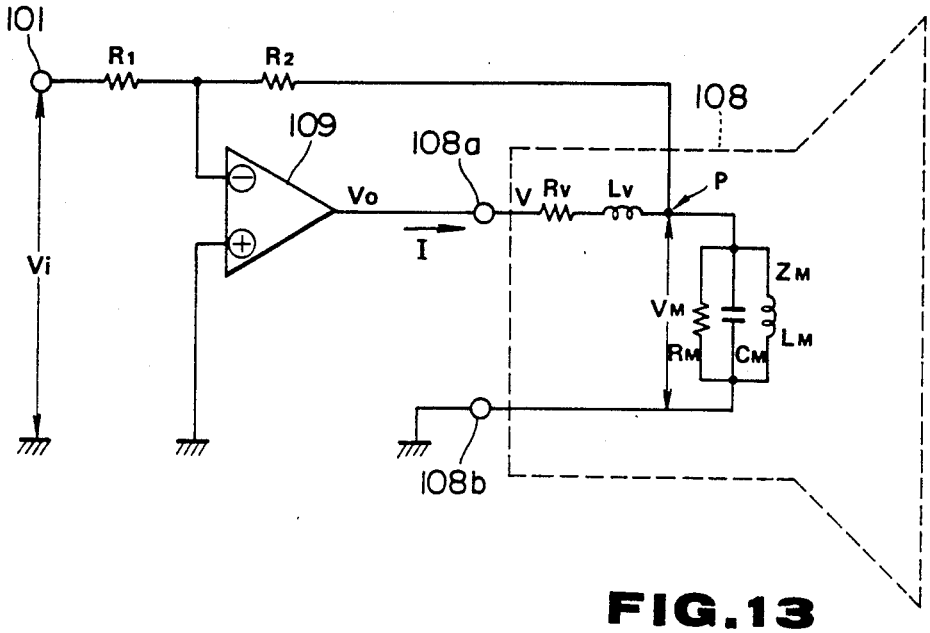
FIG. 13 is a circuit diagram showing a modified example of the second embodiment.

By the way, it is possible to obtain an equivalent circuit as shown in FIG. 13 by simplifying the circuit shown in FIG. 12.

In FIG. 13, the input terminal 101 is connected to a connection point P between the motional impedance ZM and the voice coil inductance Lv of the speaker 108 via the resistors R1 and R2 in series, while the terminal **108*b* is grounded. Meanwhile, an amplifier 109 having a negative output impedance $-(Rv+jwLv)$ is newly provided. The non-inverting input terminal of this amplifier 109** is grounded, while the inverting input terminal thereof is connected to a connection point between the resistors R1 and R2.

Figure 14A:
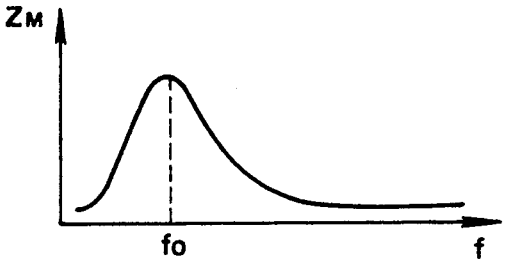
FIGS. 14A to 14C are graphs showing frequency characteristics for explaining an operation of the circuit shown in FIG. 13.
Figure 14B:
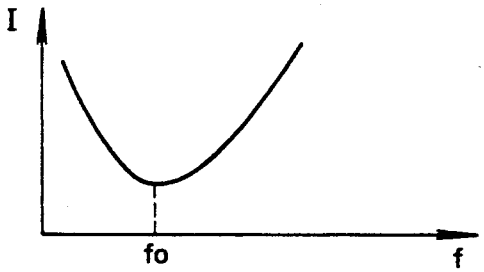
Figure 14C:
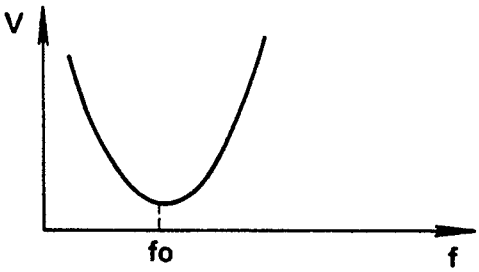

In general, the whole system of the dynamic speaker 108 including the voice coil resistance Rv and inductance Lv has a tone pressure vs frequency characteristic the curve of which is set to be flat under the constant voltage. However, it is necessary to consider the potentials at the input terminals **108*a* and 108*b* and the connection point P of the speaker 108 shown in FIG. 13 in the actual case. In this case, the motional impedance ZM having the frequency characteristic shown by FIG. 14A becomes extremely small at the frequencies other than the lowest resonance frequency f0. Hence, in order to set the voltage between the both terminals of the motional impedance ZM to the constant voltage, a drive current I of the speaker 108 must be decreased in the vicinity of the resonance frequency f0 as shown in FIG. 14B. This drive current I is actually supplied to the speaker 108 via the voice coil resistance Rv, hence, a voltage V must be produced at the terminal 108*a*. This voltage V becomes extremely large at the frequencies other than the silent resonance frequency f0 as shown in FIG. 14C. For this reason, the amplifier 109** must be saturated soon.

The above-mentioned problem can be solved by using a filter circuit as described in FIG. 7. More specifically, this filter circuit has a (frequency response) characteristic which can be obtained by electrically simulating how the loudspeaker input voltage is transmitted in response to the motional impedance. In this case, the input signal voltage Vi is supplied to the speaker 108 via this filter circuit.

[C]THIRD EMBODIMENT

Figure 15:
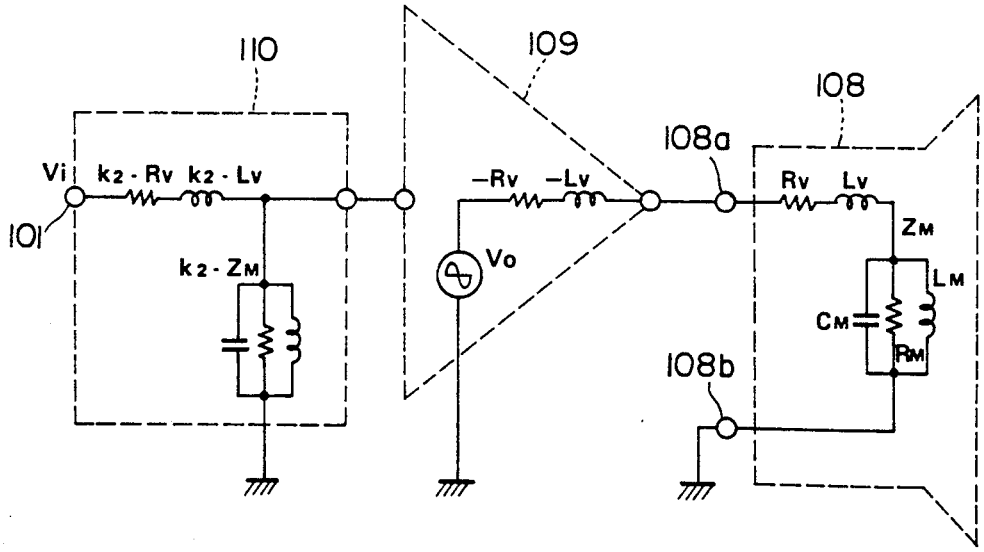
FIG. 15 is a circuit diagram showing a third embodiment of the present invention.

FIG. 15 shows a diagrammatic circuit diagram of the third embodiment of the present invention which is further provided with the above-mentioned filter circuit. In FIG. 15, 110 designates a filter circuit having a frequency response characteristic which can be obtained by electrically simulating a voltage transmission characteristic of the speaker 108. More specifically, such filter circuit 110 includes a resistance k2·Rv, an inductance k2·Lv and a motional impedance k2·ZM (where k2 denotes an arbitrary constant value).

Due to this filter circuit 110, the voltage applied to the motional impedance ZM within the speaker 108 can have the frequency characteristic identical to that of the input voltage Vi in the case where the speaker 108 is driven by the input voltage Vi. For this reason, it can be naturally said that the tone pressure vs frequency characteristic of the speaker 108 must have the flat curve. In addition, the input voltage of the amplifier 109 must be extremely low at the frequencies except for the frequencies in the vicinity of the resonance frequency f0 of the motional impedance ZM. Further, as described before, even if the circuit gain of the amplifier 109 becomes large at the frequencies other than the resonance frequency f0, the output voltage of the amplifier 109 can not become so large.

Figure 16:
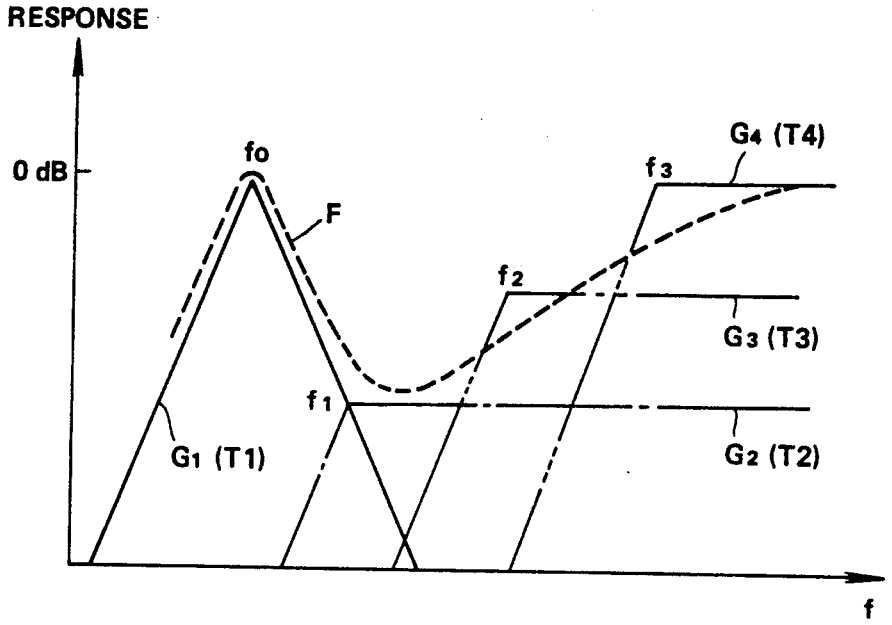
FIG. 16 is a graph showing frequency characteristics of the third embodiment.
Figure 17:
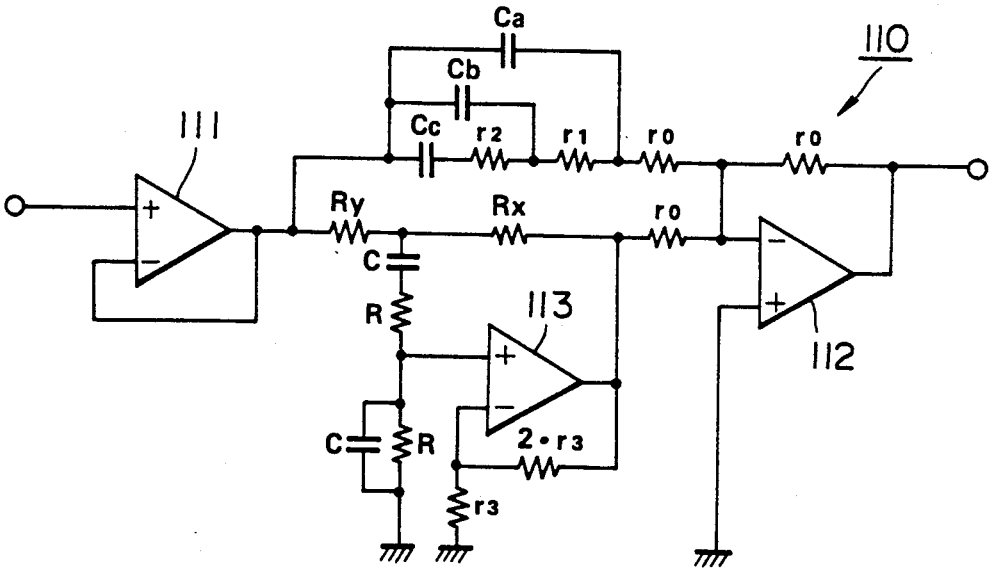
FIG. 17 is a circuit diagram showing a concrete constitution of the filter circuit 110 of the third embodiment.

Next, description will be given with respect to a concrete embodiment of the filter circuit 110 in conjunction with FIGS. 16 and 17. This filter circuit 110 must have a frequency response characteristic F which is similar to that of the speaker 108 as shown by a short dashes line in FIG. 16. In order to realize such frequency response characteristic F, this characteristic F is divided into a band-pass characteristic G1 and high-pass characteristics G2 to G4. By electrically simulating these divided characteristics, the circuit as shown in FIG. 17 can be constituted. In FIG. 16, f1 to f3 designate respective cutoff frequencies of the above-mentioned high-pass characteristics G2 to G4.

In FIG. 17, 111 and 112 respectively designate input and output buffers; an amplifier 113, a resistor R (having a resistance of 470 kilo-ohm) and a capacitor C (having a capacitance of 0.0056 micro-farad) etc. constitute a band-pass filter having the band-pass characteristic G1; resistors r0 (having a resistance of 10 kilo-ohm), r1 (having a resistance of 22 kilo-ohm) and r2 (having a resistance of 68 kilo-ohm) and capacitors Ca (having a capacitance of 0.016 micro-farad), Cb (having a capacitance of 0.01 micro-farad) and Cc (having a capacitance of 0.08 micro-farad) etc. constitute a circuit realizing the high-pass characteristics G2 to G4. As other circuit elements, resistors Ry (having a resistance of 6.8 kilo-ohm), Rx (having a resistance of 1 kilo-ohm), r3 (having a resistance of 1 kilo-ohm) and 2·r3 (having a resistance of 2 kilo-ohm) are provided.

In addition, the band-pass characteristic G1 has a time constant T1=R C; the high-pass characteristic G2 has a time constant T2=(r0+r1+r2)·Ca; the high-pass characteristic G3 has a time constant T3=(r0+r1)·Cb; and the high-pass characteristic G4 has a time constant T4=Ca.r0. Further, as shown in FIG. 16, the high-pass characteristics G2 to G4 have respective responses of r0/(r0+r1+r2), r0/(r0+r1) and r0/r0=1.

As described heretofore, the present invention is constituted so that the impedance components other than the equivalent motional impedance of the dynamic loudspeaker can be canceled. Hence, it becomes unnecessary to consider the value Q and the lowest resonance frequency f0. In addition, it becomes possible to eliminate a low-frequency tone reproducing limitation due to the resonance frequency f0.

On the other hand, the present invention is provided with the filter circuit and driving means. Such filter circuit has the frequency response characteristic which can be obtained by electrically simulating the voltage transmission characteristic against the equivalent motional impedance of the dynamic loudspeaker, so that this filter circuit can give a desirable frequency compensating characteristic to the input signal. The driving means has a negative output impedance which cancels the impedance components other than the equivalent motional impedance. This driving means drives the dynamic loudspeker by the input signal which is supplied thereto via the above filter circuit. Hence, it is possible to arbitrarily raise the level of the low-frequency characteristic in principle by setting the level of the low-frequency characteristic large when setting the characteristics of the filter circuit. Accordingly, it is possible to reproduce ultra-low-frequency tones by use of a small-size speaker.

Above is description of preferred embodiments of the present invention. This invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A dynamic loudspeaker driving apparatus comprising:

(a) an amplifier having an open-loop-gain for driving a dynamic loudspeaker;

(b) detecting means for detecting a motional voltage applied to an equivalent motional impedance of said dynamic loudspeaker;

(c) feedback means for negatively feedbacking said motional voltage to an input terminal of said amplifier by a transmission gain "1"; and (d) input means for supplying an input signal to said input terminal of amplifier via a filter circuit which electrically simulates a voltage transmission characteristics against said equivalent motional impedance of dynamic loudspeaker.

2. A dynamic loudspeaker driving apparatus according to claim 1 wherein said detecting means is a bridge circuit comprised of four impedance portion, one of which is an impedance of said dynamic loudspeaker including said equivalent motional impedance.

3. A dynamic loudspeaker driving apparatus comprising:

(a) a filter circuit having a frequency response characteristic which is obtained by electrically simulating a voltage transmission characteristic against an equivalent motional impedance of a dynamic loudspeaker, said filter circuit giving a desirable frequency compensating characteristic to an input signal; and (b) driving means having a negative output impedance which can cancel electrical impedance components of said filter circuit other than said equivalent motional impedance, said driving means driving said dynamic loadspeaker by an output signal of said filter circuit;

wherein said filter circuit comprising at least a band-pass filter and a high-pass filter, said band-pass filter having a band-pass frequency range the center frequency of which is nearly set equal to a lowest resonance frequency of said dynamic loudspeaker, said high-pass filter having a cut-off frequency which is set higher than said lowest resonance frequency.

4. A dynamic loudspeaker driving apparatus according to claim 3 wherein said driving means comprises (a) a power amplifier for amplifying said output signal of said filter circuit so that the amplified output signal is supplied to a first input terminal of said dynamic loadspeaker; and (b) a servo amplifier for negatively feedbacking a voltage at a second input terminal of said dynamic loudspeaker to said power amplifier.

5. A dynamic loudspeaker driving apparatus according to claim 3 wherein said impedance components other than said equivalent motional impedance are identical to impedance components of a voice coil of said dynamic loudspeaker.

6. A dynamic loudspeaker driving apparatus comprising:

(a) a power amplifier comprising a first operational amplifier for amplifying an input signal so that the amplified input signal is supplied to a first input terminal of a dynamic loudspeaker having an equivalent motional impedance; and (b) a servo amplifier comprising an amplifier having a negative gain for negatively feedbacking a voltage at a second input terminal of said dynamic loudspeaker to said power amplifier whereby electrical impedance components of said power amplifier other than said equivalent motional impedance can be cancelled;

said input signal being supplied to an inverting input terminal of said first operational amplifier via a first resistor, a non-inverting input terminal of said first operational amplifier being grounded, an output terminal of said servo amplifier being connected to said inverting input terminal of said first operational amplifier via a second resistor, an output terminal of said first operational amplifier being connected to said first input terminal of said dynamic loudspeaker and also connected to said inverting terminal input thereof via third resistor and an input terminal of said servo amplifier being connected to said second input terminal of said dynamic loudspeaker.

7. A dynamic loudspeaker driving apparatus according to claim 6 wherein said servo amplifier comprises a second operational amplifier, first and second impedance loads, a non-inverting input terminal of said second operational amplifier being grounded, said second input terminal of said dynamic loudspeaker being connected to an inverting input terminal of said second operational amplifier via said first impedance load, an output terminal of said second operational amplifier being connected to said inverting input terminal of said first operational amplifier via said second resistor, said inverting input terminal of said second operational amplifier being connected to the output terminal thereof via said second impedance load.

* * * * *

UNITED STATES PATENT AND TRADEMARK OFFICE

CERTIFICATE OF CORRECTION

PATENT NO. : 5,031,221

DATED : July 9, 1991

INVENTOR(S) : Kenji Yokoyama

It is certified that error appears in the above-identified patent and that said Letters Patent is hereby corrected as shown below:

Column 1, line 37: "dashes" should read as --dashed--

Column 1, line 55: "low-ass" should read as --low-pass--

Column 4, line 28: "electric first" should read as --electric constitution of the first--

Column 6, line 23: "anon-inventing" should read as --a non-inverting--

Column 8, line 38: "VO (a" should read as --VO·(a--

Column 11, line 1: "/Z]" should read as --/ZM]--

Column 13, line 3: "dashes" should read as --dashed--

Column 13, line 28: "T1=R C;" should read as --T1=R·C;--

UNITED STATES PATENT AND TRADEMARK OFFICE

CERTIFICATE OF CORRECTION

PATENT NO. : 5,031,221

DATED : July 9, 1991

INVENTOR(S) : Kenji Yokoyama

It is certified that error appears in the above-identified patent and that said Letters Patent is hereby corrected as shown below:

Column 13, line 55: "loudspeker" should read as --loudspeaker--

Column 14, line 38, Claim 3: "loadspeaker" should read as --loudspeaker--

Column 14, line 53, Claim 4: "loadspeaker" should read as --loudspeaker--

Signed and Sealed this

Second Day of March, 1993

*Attest:*

STEPHEN G. KUNIN

*Attesting Officer*

*Acting Commissioner of Patents and Trademarks*